US005498480A

United States Patent [19]

Tank et al.

[11] Patent Number: 5,498,480

[45] Date of Patent: Mar. 12, 1996

[54] COMPOSITE DIAMOND ABRASIVE COMPACT

[76] Inventors: Klaus Tank, 9 Warbleton Avenue, Essexwold, Johannesburg, Transvaal; Peter N. Tomlinson, 315 Enford Road, Mondeor, Johannesburg, Transvaal; Trevor J. Martell, 10 Kingfisher Road, Tableview, Cape Town, Cape Province; Andrew I. Lloyd, 52 15th Street, Parkhurst, Johannesburg, Transvaal; Bruce R. Olmstead, 130 Ormonde Drive, Mondeor, Johannesburg, Transvaal, all of South Africa

[21] Appl. No.: 238,964

[22] Filed: May 5, 1994

Related U.S. Application Data

[63] Continuation of Ser. No. 895,523, Jun. 2, 1992, abandoned.

[30] Foreign Application Priority Data

Jun. 4, 1991 [ZA] South Africa ..... 91/4229

[51] Int. Cl.[6] ..... B32B 27/14

[52] U.S. Cl. ..... 428/408; 51/295; 51/307; 51/309; 428/212; 428/216; 428/469; 428/472; 428/698

[58] Field of Search ..... 51/309, 307, 295; 428/408, 698, 472, 464, 212, 216

[56] References Cited

U.S. PATENT DOCUMENTS

| | | | |
|---|---|---|---|
| 3,745,623 | 7/1973 | Wentorf, Jr. et al. | 407/119 |
| 3,909,895 | 10/1975 | Abrahamson | 29/95 |
| 4,311,490 | 1/1982 | Bovenkerk et al. | 51/307 |
| 4,403,015 | 9/1983 | Nakai et al. | 428/565 |
| 4,442,180 | 4/1984 | Hara et al. | 428/551 |
| 4,731,296 | 3/1988 | Kikuchi et al. | 76/DIG. 11 |
| 4,743,515 | 5/1988 | Fischer et al. | 428/698 |
| 4,802,895 | 2/1989 | Burnand et al. | 51/293 |
| 4,820,482 | 4/1989 | Fischer et al. | 419/15 |
| 5,037,704 | 8/1991 | Nakai et al. | 428/553 |
| 5,154,245 | 10/1992 | Waldenström et al. | 175/420.2 |

FOREIGN PATENT DOCUMENTS

| | | |
|---|---|---|
| 0180243 | 5/1986 | European Pat. Off. . |
| 0296055 | 12/1988 | European Pat. Off. . |
| 0412649 | 2/1991 | European Pat. Off. . |
| 0418078 | 3/1991 | European Pat. Off. . |
| 0422435 | 4/1991 | European Pat. Off. . |
| 63-199870 | 8/1988 | Japan . |
| 1-246361 | 10/1989 | Japan . |

*Primary Examiner*—A. A. Turner

*Attorney, Agent, or Firm*—Scully, Scott, Murphy & Presser

[57] ABSTRACT

A composite diamond abrasive compact comprises a diamond compact bonded to a cemented carbide support along a compact/carbide interface and is characterised by the carbide support comprising at least two zones, a first zone containing a binder metal content of a predetermined amount, and a second zone extending from the interface to the first zone and having a binder metal content which is substantially lower than that of the first zone. The second zone has a depth or thickness of no more than 0,75 mm. The binder metal content of the second zone increases from the interface to the first zone in a continuous, non-interrupted manner.

7 Claims, 3 Drawing Sheets

COMPOSITE DIAMOND ABRASIVE COMPACT

This is a continuation of U.S. application Ser. No. 895,523 filed on Jun. 2, 1992, now abandoned.

BACKGROUND OF THE INVENTION

This invention relates to composite diamond abrasive compacts.

A composite diamond abrasive compact consists of a diamond compact bonded to a cemented carbide substrate or support. Such compacts are well known in the art and have been described extensively in the patent and other literature. They have also found wide commercial application.

Composite diamond abrasive compacts are generally manufactured by placing a layer of diamond particles on a cemented carbide body to form an unbonded assembly and then subjecting that unbonded assembly to elevated temperature and pressure conditions at which diamond is crystallographically stable. Cobalt from the carbide substrate infiltrates the diamond mass during the compact manufacture. In so doing, the carbide substrate is depleted of cobalt giving rise to stresses in the substrate. These stresses can lead to failure of the composite compact, e.g. delamination of the diamond compact and carbide support layers, during treatment in furnace brazing.

U.S. patent specification No. 3,745,623 describes a method of making a composite diamond abrasive compact. In one embodiment of the method, there is not a sharp transition from a carbide-cobalt powder mix (for the carbide substrate) to the diamond powder mix. Instead, a transition layer between the carbide-cobalt mass and the diamond layer may be provided, that transition layer containing both carbide-cobalt powder and diamond grit in a gradated mix to minimise stress concentrations.

U.S. Pat. No. 4,802,895 describes a method of making a composite diamond abrasive compact in which a thin layer of fine carbide powder is placed on a surface of a carbide body and a mass of fine diamond particles mixed with powdered cobalt placed on the layer of carbide powder. That unbonded assembly is then subjected to the usual conditions of elevated temperature and pressure to produce the composite diamond abrasive compact.

U.S. Pat. No. 4,311,490 describes a method of making a composite diamond abrasive compact in which the diamond mass consists of two layers, a coarse layer being closest to the catalyst metal, i.e. the cobalt, and the finest layer being disposed furthest away from the catalyst metal. The source of cobalt is the carbide substrate.

U.S. Pat. No. 4,403,015 describes a method of making a composite abrasive compact in which there is an intermediate bonding layer between the compact and the carbide substrate. This intermediate bonding layer comprises cubic boron nitride in an amount of less than 70 volume percent and the residual part principally consisting of a compound selected from among carbides, nitrides, carbonitrides or borides of IVa, Va, VIa transition metals of the Periodic Table, an admixture thereof, or a mutual solid solution compound thereof.

SUMMARY OF THE INVENTION

According to the present invention, a composite diamond abrasive compact comprising a diamond compact bonded to a cemented carbide support along a compact/carbide interface is characterised by the carbide support comprising at least two zones, a first zone containing a binder metal content of a predetermined amount and a second zone extending from the interface to the first zone and having a binder metal content substantially lower than the predetermined amount, the second zone having the depth or thickness no more than 0,75 mm, typically no more than 0,6 mm and preferably no more than 0,4 mm. The second zone will generally have a depth or thickness of at least 0,2 mm.

DESCRIPTION OF EMBODIMENTS

By ensuring that the carbide support has two zones as defined above, it has been found that stresses introduced into the carbide support of a composite diamond abrasive compact of the invention are substantially redistributed or altered and that this leads to beneficial results. The binder metal content of the zone which borders on the compact/carbide interface is substantially lower than that of the remainder or first zone of the support. The binder metal content of the second zone will generally vary from a low amount at the compact/interface to a higher amount in the region that the second zone changes to the first zone. The binder content of the second zone as a whole will remain substantially below that of the first zone.

Figure 1:
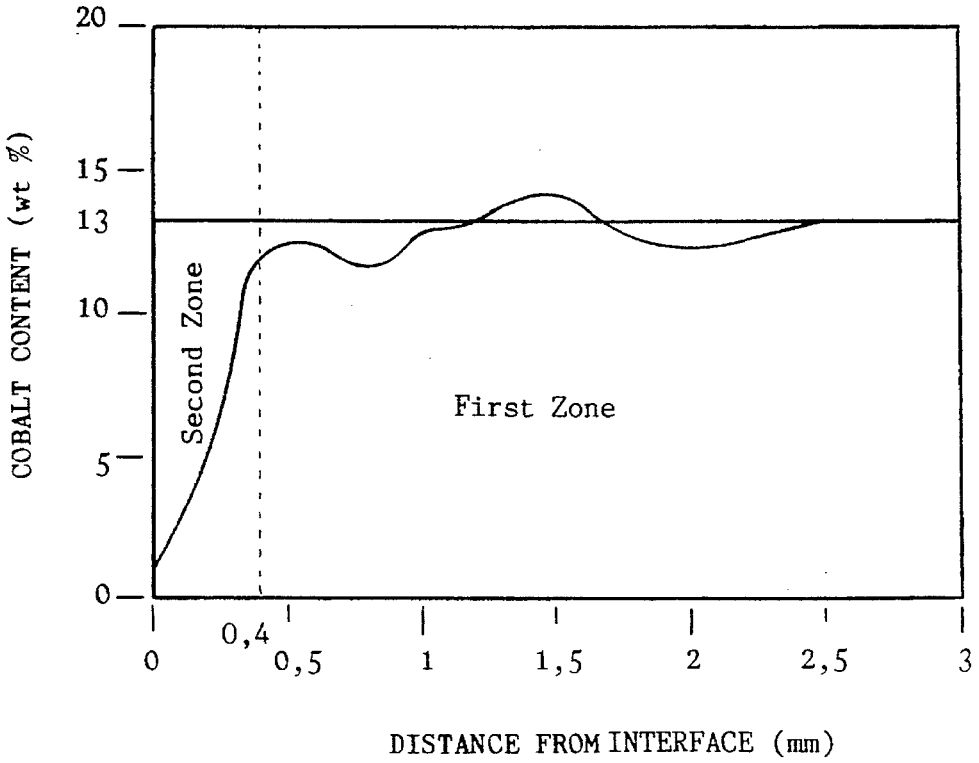
FIGS. 1 and 2 are graphs showing the cobalt concentration of a cemented carbide support of a composite diamond abrasive compacts of the invention.
Figure 2:
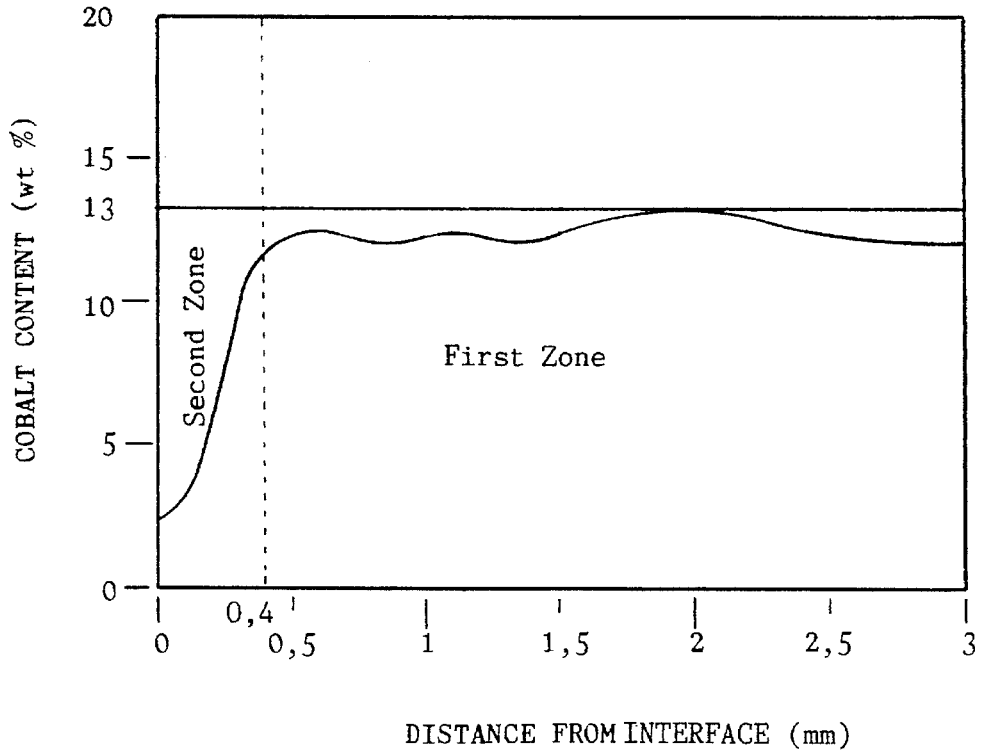

This may be illustrated graphically by FIGS. 1 and 2 which show the cobalt content (weight percent) of the carbide support as a function of distance from the compact/carbide interface (in mm). The depth or thickness of the carbide in each instance was of the order of 12 to 13 mm, although similar profiles were obtained with carbide thicknesses of 6 to 8 mm. It will be noted that in a zone (the second zone) extending from the interface to a depth of no more than 0,4 mm, there is a cobalt lean region which starts at a low value at the interface and then rises sharply to a level which is at, or close to, the cobalt content of the balance (the first zone) of the support. In particular, it will be noted that the binder metal content of the second zone at the interface is from 15 to 30 percent of the binder metal content of the balance or first zone of the support, and that this binder metal content increases to a value of at least 90 percent of the binder metal content of the balance of the support (the first zone) in the region that the second zone changes to the first zone. This increase takes place in a continuous and non-interrupted manner.

Figure 3:
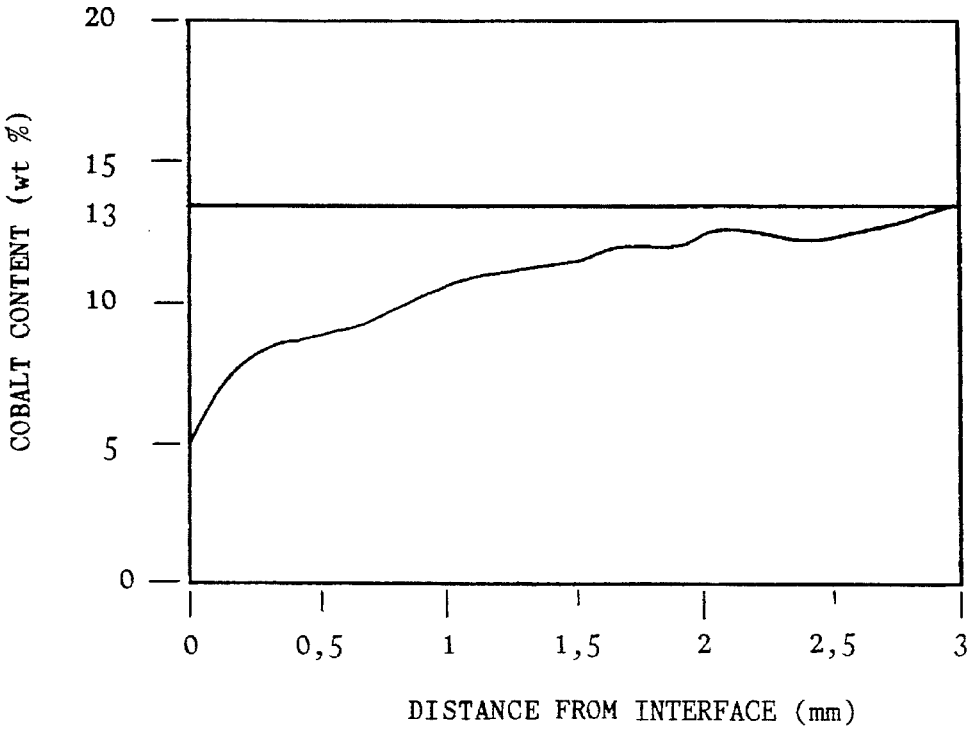
FIGS. 3 and 4 are graphs showing the cobalt concentration of a cemented carbide support of a composite diamond abrasive compact of the prior art.
Figure 4:
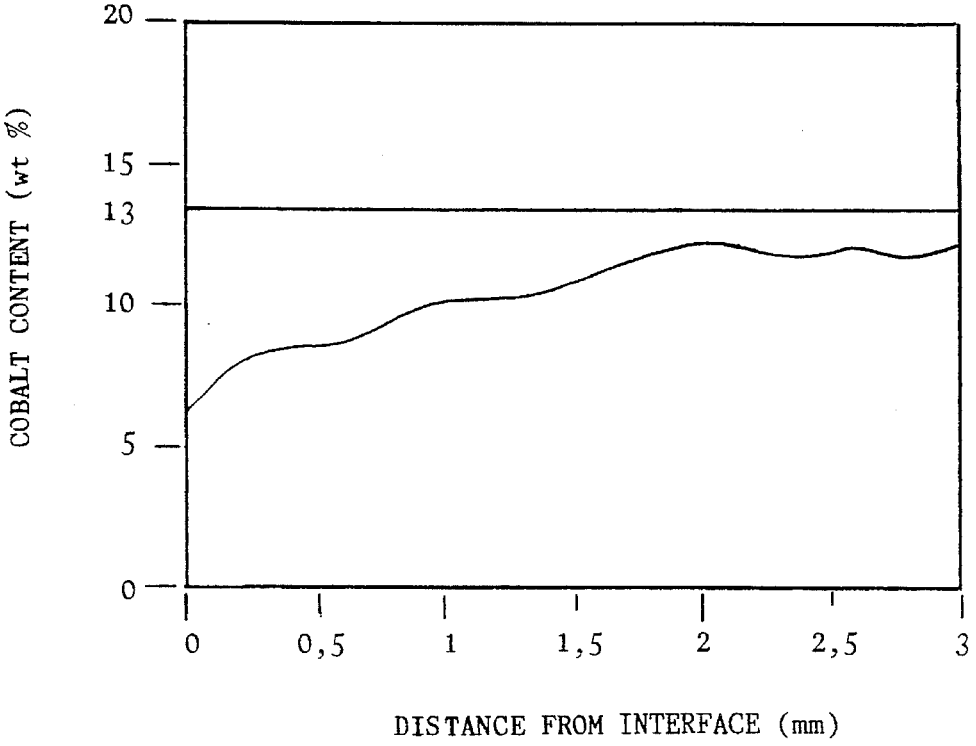

This is to be contrasted with the cobalt profile of a carbide support of a prior art composite diamond abrasive compact illustrated graphically by FIGS. 3 and 4. It will be noted that the slope of the graph is shallower and also that the cobalt lean region extends well beyond 0,4 mm. Stresses were found to exist in the carbide supports of the compacts of FIGS. 3 and 4 leading to delamination of the carbide from the compact during furnace brazing. Such delamination did not occur with the composite compacts of FIGS. 1 and 2. The delamination test involved heating a crucible filled with braze alloy to a particular temperature using an induction coil, immersing the composite diamond abrasive compact for a pre-set period of time in the molten braze, cooling the composite compact to room temperature and examining the product for any sign of delamination or other thermally induced failure.

The invention has particular application to composite diamond abrasive compacts which are intended to be used as inserts for drill bits. Such composite abrasive compacts will generally have a length of 3 to 13 mm with the diamond compact layer contributing no more than a ½ mm to this length. Thus, the carbide supports will generally have a length of 2,5 to 12,5 mm.

The composite diamond abrasive compact of the invention may be made using known process conditions, save that the maximum elevated temperature and pressure conditions should be maintained for a relatively short period, e.g. 5 to 8 minutes only. It is these conditions that were used in producing the composite diamond abrasive compacts from which the graphs of FIGS. 1 and 2 were produced. For the composite diamond abrasive compacts used to produce the graphs of FIGS. 3 and 4, the maximum elevated temperature and pressure conditions were maintained for a period of the order of 15 minutes in each case.

The carbide particles of the carbide support may be fine preferably 1 to 3 microns, or medium preferably 3 to 6 microns. For fine carbide particles the binder metal content will typically be about 13% by weight. For medium carbide particles the binder metal content will typically be about 13,5% by weight. A binder metal content in the first zone of 12 to 14 percent by weight is typical. The binder metal may be any known in the art such as cobalt, iron or nickel, or an alloy containing one or more of these metals.

The diamond particles may be in loose or bonded form prior to compact formation. When in bonded form, they may be bonded by means of a suitable organic binder such as cellulose which will readily volatilise under the elevated temperature and pressure conditions employed to produce the diamond compact.

Figure 5:
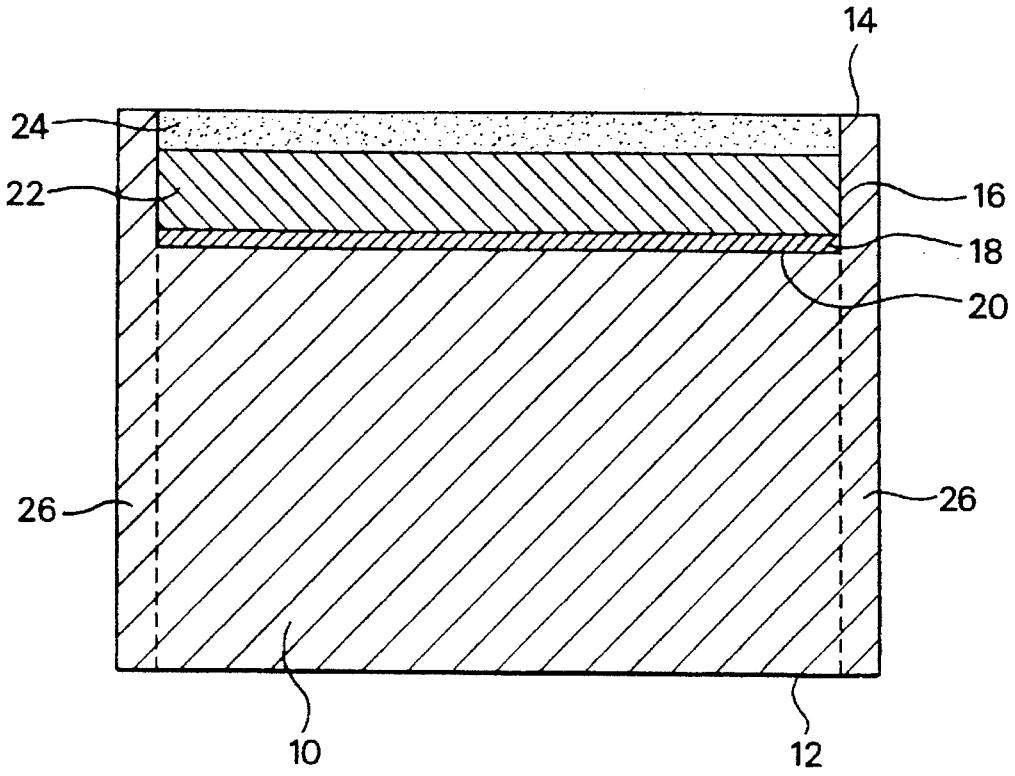
FIGS. 5 and 6 illustrate sectional side views of two unbonded assemblies useful in the practice of the invention.
Figure 6:
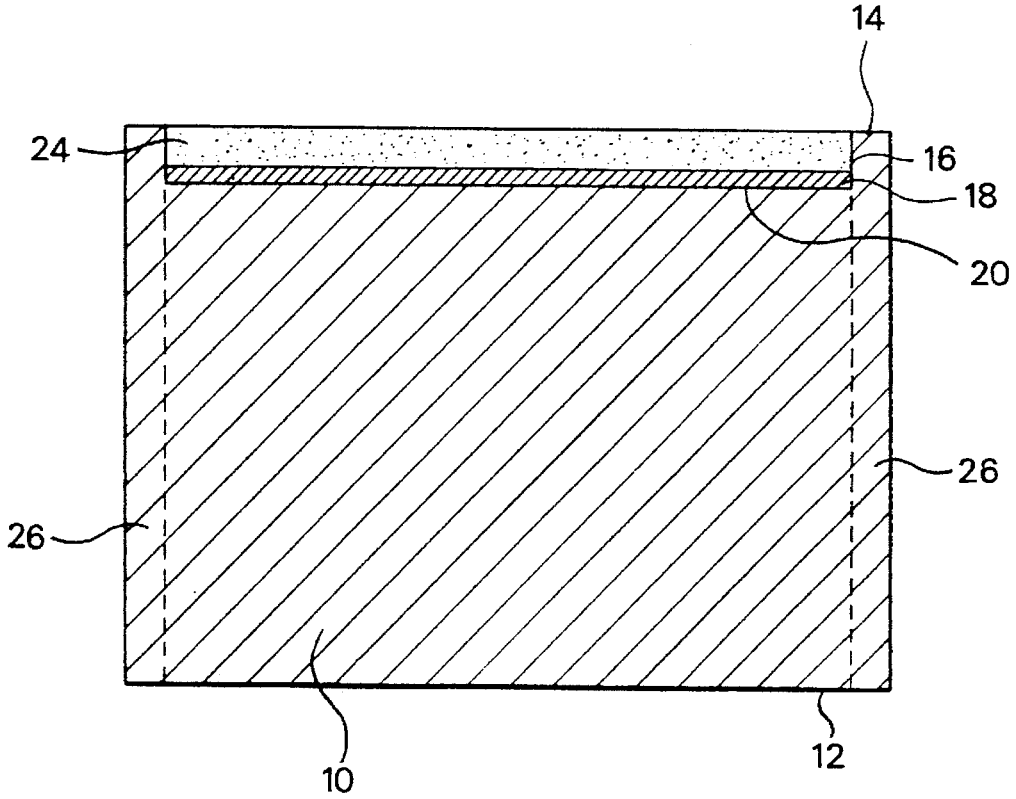

FIGS. 5 and 6 illustrate two unbonded assemblies which may be used in producing the composite diamond abrasive compact of the invention. Referring first to FIG. 5, there is shown a cemented carbide body 10 having a lower surface 12 and an upper surface 14. A recess 16 is formed in the upper surface 14.

Located in the recess 16 are three discrete layers. The first layer 18 is in contact with the surface 20 of the body 10 and is a cobalt shim. The second layer 22 is a layer of bonded carbide particles. The third layer 24 is a layer of bonded diamond particles.

The layers 22 and 24 are both formed by first mixing the particular particle with methyl cellulose and then heating that mixture to a temperature of the order of 100° C. to form a sintered mass. It is this sintered mass which is then placed in the recess 16.

The unbonded assembly is heated to a temperature of about 350° C. This has the effect of driving off or volatilising the methylcellulose binder from layers 22, 24. The assembly is then placed in a reaction capsule. The loaded capsule is placed in the reaction zone of the high temperature/high pressure apparatus. The contents of the capsule are subjected to a temperature of 1500° C. and a pressure of 50 kilobars and these elevated conditions are maintained for a period of about 5 to 8 minutes. During this time, cobalt from the layer 18 infiltrates both the layers 22 and 24 producing in these layers cemented carbide and a diamond compact, respectively. Some infiltration of cobalt into the body 10 occurs. A strong bond is produced between the layers 22 and 24 and between the layer 22 and the body 10.

The bonded product may now be recovered from the reaction capsule using conventional techniques. The sides 26 of the body 10 may be removed, for example by grinding, to the dotted lines to produce a composite diamond abrasive compact.

FIG. 6 illustrates a second embodiment of the invention in which like parts carry like numerals. In this unbonded assembly there is no layer 22 of bonded carbide particles—the cemented carbide body 10 extends to the cobalt shim 18.

The composite diamond abrasive compacts produced using the unbonded assemblies of each of FIGS. 5 and 6 and the temperature and pressure conditions described in relation to the FIG. 5 embodiment have a cobalt binder profile in the carbide support as illustrated by FIGS. 1 and 2. In each case, delamination of the carbide support from the diamond compact was found not to occur when the composite abrasive compact was brazed into the working surface of a drill bit or like tool and subsequently used.

We claim:

1. A composite diamond abrasive compact comprising a diamond compact layer bonded entirely across the surface of a cemented carbide support along a compact/carbide interface, the carbide support comprising at least two zones, a first zone containing a binder metal content of a predetermined amount, and a second zone extending from the interface to the first zone and having a binder metal content at the interface of from 15 to 30% of the binder metal content of the first zone, the binder metal content of the second zone increasing to at least 90% of the binder metal content of the first zone in the region whereat the second zone changes to the first zone, the second zone having a depth or thickness of at least 0.2 mm to no more than 0.75 mm.

2. A composite diamond abrasive compact according to claim 1 wherein the second zone has a depth or thickness of no more than 0,6 mm.

3. A composite diamond abrasive compact according to claim 1 wherein the second zone has a depth or thickness of no more than 0,4 mm.

4. A composite diamond abrasive compact according to claim 1 wherein the binder metal content of the carbide support increases in a continuous, non-interrupted manner in the second zone from the compact carbide interface to the first zone.

5. A composite diamond abrasive compact according to claim 1 wherein the length of the carbide behind the diamond compact is about 2,5 to 12,5 mm.

6. A composite diamond abrasive compact according to claim 1 wherein the binder metal content of the first zone is about 12 to 14 percent by weight.

7. A composite diamond abrasive compact according to claim 1 wherein the binder metal is selected from cobalt, iron, nickel and alloys containing one or more of these metals.

* * * * *